United States Patent [19]

Hutchings

[11] Patent Number: 4,574,947

[45] Date of Patent: Mar. 11, 1986

[54] DISPENSING CONTAINER WITH DISPLAY COMPARTMENT

[76] Inventor: Alexander W. Hutchings, 12 Vickburg Station, St. Charles, Mo. 63301

[21] Appl. No.: 649,438

[22] Filed: Sep. 11, 1984

[51] Int. Cl.[4] ..... B65D 85/00

[52] U.S. Cl. ..... 206/45.34; 206/216; 220/23; 220/340; 222/130

[58] Field of Search ..... 206/45.31, 45.34, 44.11, 206/216; 220/340, 334, 345, 377, 23, 94 R; 229/17; 222/130, 556

[56] References Cited

U.S. PATENT DOCUMENTS

| | | | |
|---|---|---|---|
| 2,563,141 | 8/1951 | Vazzano | 220/130 X |
| 2,604,976 | 7/1952 | Sarg | 206/45.34 |
| 2,605,892 | 8/1952 | Waber et al. | 220/345 X |
| 2,906,439 | 9/1959 | Santuci, Sr. | 222/556 |
| 3,095,109 | 6/1963 | Exton | 220/23 |
| 3,111,153 | 11/1963 | Sonka et al. | 220/94 R |
| 3,112,829 | 12/1963 | Lemelson | 206/216 |
| 3,380,617 | 4/1968 | Kramer | 220/334 |
| 3,474,933 | 10/1969 | Malpar | 220/130 X |
| 3,679,093 | 7/1972 | Chang | 220/23 X |

*Primary Examiner*—Allan N. Shoap
*Assistant Examiner*—Bryon Gehman
*Attorney, Agent, or Firm*—Kalish & Glister

[57] ABSTRACT

A dispensing container incorporating front, rear and end walls, a bottom wall, and being normally opened at the top. The container is configured so that the upper edges of the walls thereof define vertically spaced apart upper and lower parallel edge portions interconnected by an intervening inclined portion. A closure of complementary contour to the configuration of the upper open end of the container is provided, with there being a hinged closure flap in normal covering relation to the container upper edge portion. By reason of the configuration of the container, a relatively reduced volume is presented beneath the closure flap for facilitating content dispensation. An independent chamber-defining member is slidably received upon said closure for creating an article display compartment. The container and chamber-defining member are fabricated of transparent plastic material.

8 Claims, 9 Drawing Figures

FIG. 1
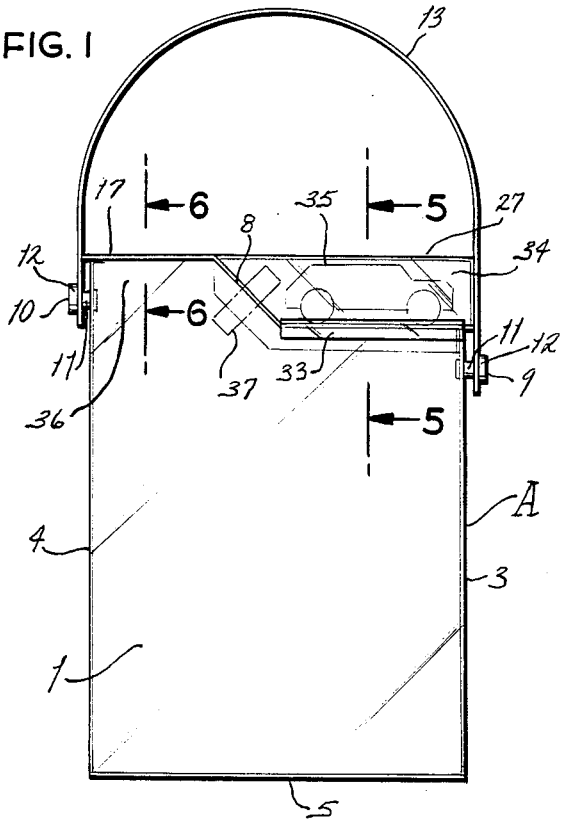
FIG. 2
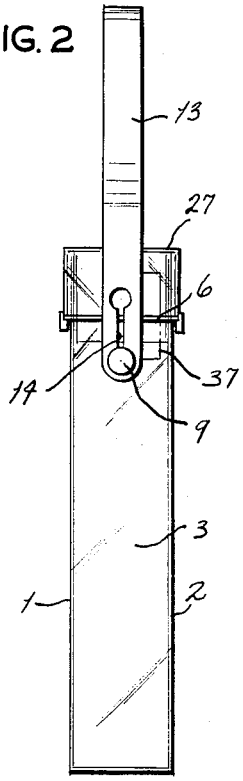
FIG. 3
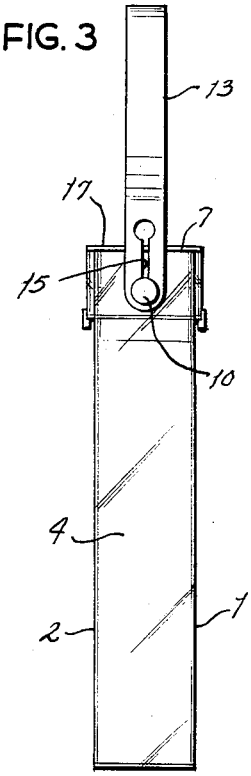
FIG. 5
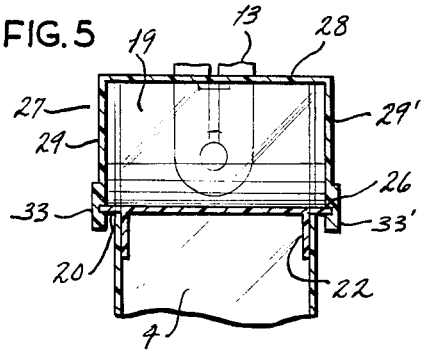
FIG. 4
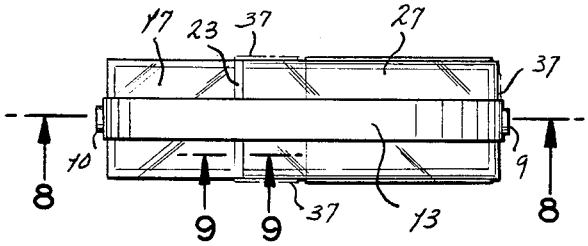
FIG. 6
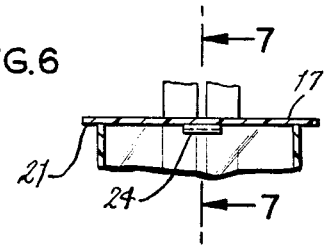
FIG. 7
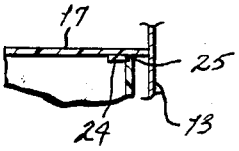
FIG. 8
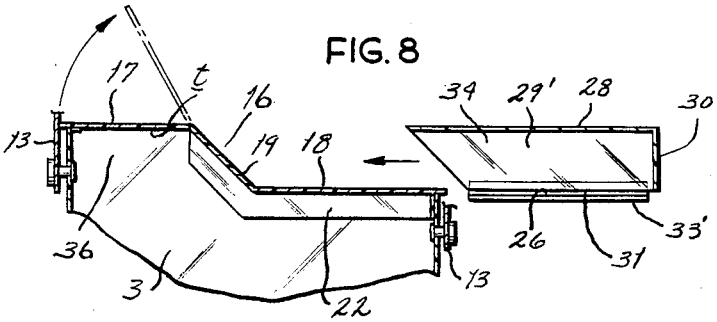
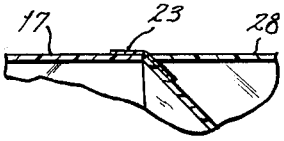
FIG. 9

DISPENSING CONTAINER WITH DISPLAY COMPARTMENT

BACKGROUND AND SUMMARY OF THE INVENTION

This invention relates in general to receptacles and, more particularly, to a dispensing container uniquely adapted for a broad range of merchandise.

Heretofore in the packaging art, as the same relates to consumer items as, for example, of the general type offered in supermarkets, drug stores, convenience stores, and the like, the material of construction has for the most part consisted of cellulosic material, metal, and opaque plastics. Thus the consumer has been restricted to viewing the labeling for obtaining some idea as to the expected appearance and character of the contained commodity. Direct observation has been systematically denied.

Additionally, commonly used containers as above described are of throw-away character, particularly in light of substantial destruction through usage. Therefore, the present invention provides a container of transparent, durable material with the contents being fully visible to the consumer prior to purchase, whereby the precise condition and nature thereof is apparent.

Furthermore, containers of the present invention are adapted for usage after the original contents have been exhausted and accordingly have a prolonged life.

Currently the general concept of providing a premium item with merchandise has for the most part consisted of merely disposing such item within the contents of the particular container so that the premium is not actually seen, but merely visualized as by way of pictorial presentation. Thus, the producer of the merchandise is unable to permit the prospective customer the opportunity of viewing the premium so that the invitation to purchase motivated thereby is prevented.

The present invention contemplates a container adapted for a wide variety of merchandise for household use, such as, animal foods, cereals, powdered detergents, sugar, cotton balls, ad infinitum, which are rendered visible through the transparent walls of the container. The container embodies a unique closure construction which may be readily placed in operative position and incorporates a flap type lid for facile dispensing of the contents as through pouring. Additionally, the container includes a transparent, detachably engageable chamber-forming unit designed to receive a premium item which is thus physically remote from the merchandise and constitutes an independent center of interest; whereby the full impact of the attractiveness thereof may be made upon the prospective purchaser.

Accordingly, it is an object of the present invention to provide a container fabricated of inert, durable plastic material which is transparent, being designed for receiving a wide range of merchandise which is fully visible through the walls of the container.

It is another object of the present invention to provide a container of the type stated which embodies a detachable closure which when in operative position constitutes the top wall of the container and incorpores a hinged lid or flap member for facile dispensation of the container contents.

It is another object of the present invention to provide a container of the character stated which is of unique configuration for providing an air chamber so that the content dispensation is effected in a smooth, reliable manner.

It is a still further object of the present invention to provide a container of the character stated having a detachably engageable component adapted to coact with the container to form a discrete chamber for displaying a premium item which is, thus, physically removed from the container contents; being entirely visible for inspection by a prospective purchaser.

It is another object of the present invention to provide a container of the character stated which is adapted for ease of portability; which is of lightweight, but of highly durable construction, so as to have a useful life after exhaustion of the contents; which may be economically manufactured; which will lend itself to pleasing surface decoration; and which is fully reliable in usage.

BRIEF DESCRIPTION OF THE DRAWINGS

FIG. 1 is a side elevational view of a dispensing container constructed in accordance with and embodying the present invention.

FIG. 2 is an end elevational view taken at the right hand side of FIG. 1.

FIG. 3 is an end elevational view taken on the left hand side of FIG. 1.

FIG. 4 is a top plan view.

FIG. 5 is a vertical transverse sectional view taken on the line 5—5 of FIG. 1.

FIG. 6 is a vertical transverse sectional view taken on the line 6—6 of FIG. 1.

FIG. 7 is a fragmentary vertical transverse sectional view taken on the line 7—7 of FIG. 6.

FIG. 8 is a vertical transverse sectional view taken on the line 8—8 of FIG. 4 showing the closure flap in open condition in phantom lines, and the chamber-forming component in detached condition.

FIG. 9 is a fragmentary horizontal transverse sectional view taken on the line 9—9 of FIG. 4 illustrating the hinge of the said closure flap.

DESCRIPTION OF THE PREFERRED EMBODIMENT

Referring now by reference characters to the drawing which illustrates the preferred embodiment of the present invention, A designates a dispensing container as used primarily for shelf merchandise in supermarkets, grocery stores, drug stores, convenience stores, and the like; and which container incorporates front and rear walls 1, 2, respectively, end walls 3, 4 and a bottom wall 5. The container is normally open to the top, as at t. The material of construction of container A is a transparent plastic such as, for example, polycarbonate; which selected plastic is inert so as to avoid any interreaction with the contents. Transparency of container A. thus permits full disclosure of the contents so that a viewer is readily apprised of the condition and character thereof and is not remitted to the necessity of surmising as to such. It will be appreciated that the walls of container A are of sufficient thickness, as in the order of one-sixteenth of an inch or greater, to render the container sturdy and of high durability; being useful as a receptacle for a substantial period long subsequent to exhaustion of the original contents.

The upper edges of the upstanding or vertical walls 1, 2, 3, 4 are configured to provide axially aligned, horizontal, parallel, lower and upper end portions 6, 7, respectively, which, at the proximate ends thereof, are continuous with an interconnecting inclined section 8. The lower end portion 6 is of greater extent than upper end portion 7; the former having a length substantially equal to one-half the length of container A.

Fixed to the outer surface of each end wall 3, 4 near the upper end thereof, projecting laterally outwardly therefrom, is a button-like strap support 9, 10, respectively, each of which embodies a stem 11 and an enlarged head 12. Heads 12 are engaged to opposite end portions of a carrying strap 13, as by projection through bayonet-type apertures as at 14, 15 provided therein.

Presented for disposition within the open top t of container A is a closure element indicated generally at 16 which comprehends a configuration complementary to, and accommodating, the unique shape of the upper edges of said container. Closure 16 accordingly comprises upper and lower horizontal parallel planar sections 17, 18 intervening inclined section 19 for cooperation with edge portions 6, 7, 8, respectively, of the upper margins of container walls 1, 2, 3, 4, respectively. Said closure sections 17, 18, 19 are of greater transverse extent than that of the cooperating edge portions 6, 7, 8 so that the edges of said sections 17, 18, 19 project beyond the adjacent walls of container A as may be seen at 20, 21 in FIGS. 5, 6. Thus, by said projecting edges, closure 16 is reliably supported upon the upper margins of container A and being thus inhibited against undesired downward displacement. For rigidifying, and preserving the physical integrity of closure 16, a flange 22 depends from the under surface of said closure 16 throughout the length of lower and inclined sections 18, 19, as well as transversely of the end extremity of said upper section 18 but being spaced inwardly of the edges thereof a distance sufficient to insure of snug reception within the open top of container A for abutment on the outer face of said flange against the inner face of front and rear walls 1, 2 and end wall 3. Thus, flange 22 promotes the reliable disposition of closure 16 upon container A and prevents the escape of any contents therebetween.

Said upper planar section 17, being devoid of a flange, constitutes a closure flap or lid which along its inner transverse margin is suitably hingedly engaged to the adjacent margin of inclined section 19 by any suitable means such as, for instance, by a flexible member 23 such as tape, fabric, or the like secured by a compatible adhesive. Manifestly, other hinge forming expedients may be utilized if desired, such as by effecting a scoring between sections 17, 19. Said closure flap or upper planar section 17 in container-closed condition thus rests upon the adjacent top edges of front and rear walls 1, 2 and end wall 4. It may be secured in such condition by means of a latching projection 24 depending from the undersurface of said closure flap 17 adjacent the hinge remote or free end thereof for interlocking engagement with a cooperative latching indentation 25 provided on the inner surface of side wall 4 (see FIG. 7).

It will thus be seen that closure 16 may be easily disposed in the upper open end of container A with the projecting edge portions of the sections 17, 18, 19 thereof resting on their undersurfaces upon the adjacent edge portions of front, back and end walls 1, 2, 3 and 4 and with the extremities of said edges extending beyond said container walls. As pointed out, flange 22 materially strengthens closure 16 and conduces to its reliable retention in operative position. But it will be seen that the unique construction of closure 16 allows container A to be open throughout its full upper extent for facilitating filling operations.

As may best be seen in FIG. 5, the projecting character of the edges of lower planar section 18, as at 20, is apparent; the same being thus presented to serve as tongues for reception within grooves 26 formed in a display chamber-form member generally indicated at 27. Member 27 is also, desirably, fabricated of like material as container A so as to be fully transparent and comprises a top wall 28, side walls 29, 29' and end wall 30 and being open at the bottom as at 31 and at the forward end thereof 32. Grooves 26 are developed within elongated members 33, 33' integral with side walls 29, 29', respectively, at the lower ends thereof and being substantially coextensive therewith. Thus, said grooves 26 receive the tongue-forming outer portions of the projecting edges of planar section 18 in a relatively slidable fashion so that said member 27 may be disposed upon container A in covering relationship to sections 18, 19 of closure 16 whereby top wall 28 of member 27 will be planarwise aligned with closure section 17 when the latter is in closed condition. It will be observed that the edges of side walls 29, 29' are downwardly and outwardly inclined, complementary to the inclination of closure section 19 so as to abut thereon when member 27 is engaged upon container A. Accordingly, with chamber-forming member 27 in engaged position upon container A, as is shown in FIG. 1, the same cooperates with the adjacent parts of container A so as to present an independent display compartment 34, the interior of which is fully visible by reason of transparency of the material of construction. Although certainly numerous usages could be advanced for the use of compartment 34, the same is designed for retaining a premium item being offered with the particular contents of container A. Manifestly, such item as indicated in phantom lines at 35 may be a toy vehicle or could be of any character of an infinite potential. Thus, chamber forming member 27 is an optional feature, since without the same in mounted position, container A is in no way affected in functioning for its intended purposes. But said chamber forming member 27 provides a unique expedient in permitting the prospective purchaser to view the premium prior to purchase and to be accordingly motivated thereby; thus obviating the necessity of having the purchaser delving through the package contents after purchase to discover the exact nature of the advertised premium.

With reference again being made to FIG. 1, it will be seen that by reason of the elevation of closure section 17 upwardly of lower planar portion 18 resulting from the configuration of the upper edges of container A, a volume as indicated at 36, of reduced extent is created immediately beneath section 17 and hence the closure flap created thereby. Said volume 36 may be utilized as an air chamber for facilitating dispensation of the contents where a pouring action is required. With contents not requiring pouring, such as, for instance, cotton balls, volume 36 serves to facilitate content removal.

Closure 16 is maintained against inadvertent displacement as by means of tape or adhesive sections indicated at 37 which are located in requisite areas for interconnecting said closure 16 and the body of container A. Similarly, with chamber forming member 27 in operative position like tape or adhesive sections 37 can be extended for simultaneously retaining said member 27 against accidental, unauthorized removal, as well as to concurrently secure closure 16 in position. The precise locations of said sections 37 is a matter of choice but FIGS. 1 and 2 indicate preferable zones of application.

In view of the foregoing, it will be seen that the present invention provides a marked improvement in containers adapted for a wide range of shelf merchandise. The same is of durable construction and yet is fully transparent, according the prospective purchaser an opportunity to study the condition of the merchandise. Furthermore, the present invention includes the provision of a means for providing a display compartment for a premium item offered to motivate the purchaser wherein such item is also fully visible to the prospective customer. By reason of the construction of container A, the same will have a useful life for a considerable period of time subsequent to exhaustion of the original contents.

What is claimed is:

1. A dispensing container having a front wall, a rear wall, end walls connecting said front and rear walls, and a bottom wall, said container being normally open to the top, the upper edges of the front, rear and end walls being configured to provide upper and lower horizontal portions with there being an intervening, interconnecting inclined portion, a closure member for closing the normally open top of said container having upper and lower horizontal planar portions with an intervening inclined planar portion complementary to the configuration of the upper and lower horizontal and inclined portions configured by the upper edges of said front, rear, and end walls for operative disposition thereon, a chamber-forming member having an upper wall, side walls depending therefrom and an outer end wall, said chamber forming member being normally open in its bottom portion and in its opposite or inner end portion, the edges at the inner ends of said last-mentioned side walls being complementary to the degree of inclination of the inclined portion of said closure member, means for detachably engaging said chamber-forming member on said closure member for operatively cooperating therewith for effecting development of an enclosed chamber for article reception and display.

2. A dispensing container as defined in claim 1 wherein the side walls and the outer end wall of the chamber-forming member are of such height as to present the upper wall thereof in substantial planar alignment with the upper horizontal planar portion of said closure member when said closure member and said chamber-forming member are in operative disposition.

3. A dispensing container as defined in claim 1 or 2 wherein the chamber-forming member side walls are provided with inwardly opening grooves in the lower end portions thereof, and said closure member is provided with outwardly projecting tongue-forming side edges on the lower horizontal planar portion thereof for engagement within said grooves for maintaining said chamber-forming member in operative position.

4. A dispenser container as defined in claims 1 or 2 wherein said chamber-forming member being fabricated of transparent material for facilitating display of the contents thereof.

5. A container as defined in claim 1 wherein said upper planar portion of said closure member is hingedly engaged to the inclined planar portion of said closure member for constituting a closure flap.

6. A container as defined in claim 5 wherein latching means are provided upon said closure flap and the adjacent wall portion of said container for retaining said flap against accidental opening.

7. A container as defined in claim 1 or 2 wherein said closure member is provided with a flange depending from the inclined portion and lower planar portion thereof, said flange being located spacedly inwardly from the extremity of the adjacent edges of said planar portions for disposition within the interior of the container and in abutting relationship to the adjacent portions of the proximate walls of said container.

8. A container as defined in claim 7 wherein adhesive tape members are provided for interengaging said closure member and said container.

* * * * *